US005615629A

United States Patent [19]

Yamada et al.

[11] Patent Number: 5,615,629

[45] Date of Patent: Apr. 1, 1997

[54] THREADING APPARATUS OF SEWING MACHINE

[75] Inventors: Takahiro Yamada, Toyoake; Masao Ogawa; Eiji Shibata, both of Nagoya, all of Japan

[73] Assignee: Brother Kogyo Kabushiki Kaisha, Nagoya, Japan

[21] Appl. No.: 573,005

[22] Filed: Dec. 15, 1995

[30] Foreign Application Priority Data

Dec. 26, 1994 [JP] Japan ..... 6-322865

[51] Int. Cl.[6] ..... D05B 87/02

[52] U.S. Cl. ..... 112/225

[58] Field of Search ..... 112/224, 225, 112/253, 302, 157, 443

[56] References Cited

U.S. PATENT DOCUMENTS

| | | | |
|---|---|---|---|
| 4,649,843 | 3/1987 | Muroi et al. | 112/225 X |
| 5,088,426 | 2/1992 | Ogawa | 112/225 |
| 5,097,775 | 3/1992 | Ogawa et al. | 112/225 |

FOREIGN PATENT DOCUMENTS

| | | | |
|---|---|---|---|
| 2008787 | 1/1987 | Japan | 112/157 |
| 3-143486 | 6/1991 | Japan . | |

*Primary Examiner*—Ismael Izaguirre
*Attorney, Agent, or Firm*—Oliff & Berridge

[57] ABSTRACT

An apparatus for putting a sewing thread through an eye hole of a sewing needle of a sewing machine, including a hook member having a hook portion movable through the needle eye to catch the sewing thread positioned adjacent to the needle eye; a holding member which cooperates with the hook member to hold the sewing thread; a biasing member which biases the holding member to press the sewing thread against the hook portion of the hook member; a supporting member which supports the hook member, the holding member, and the biasing member such that the three members are movable between a distant position distant from the needle eye and a near position near to the needle eye and are movable at the near position so that the hook portion of the hook member advances and retracts through the needle eye to catch the sewing thread, draw the caught thread through the needle eye, and obtain a loop of the thread; and a releasing member which releases the sewing thread from the hook member by moving the holding member away from the hook portion of the threading hook against the biasing action of the biasing member, at least one of the supporting and releasing members being movable relative to the other member so that the holding member and the releasing member are engaged with each other and the holding member is moved away from the hook portion of the hook member against the biasing action of the biasing member.

14 Claims, 11 Drawing Sheets

FIG.12A
PRIOR ART
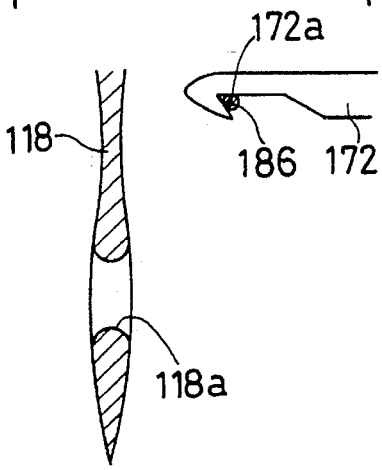
FIG.12B
PRIOR ART
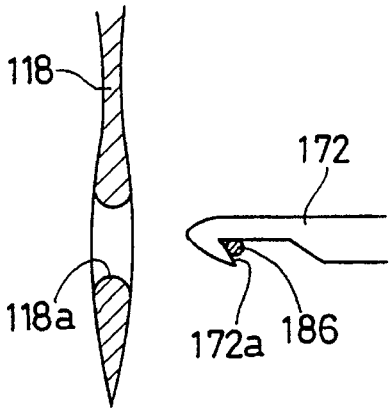
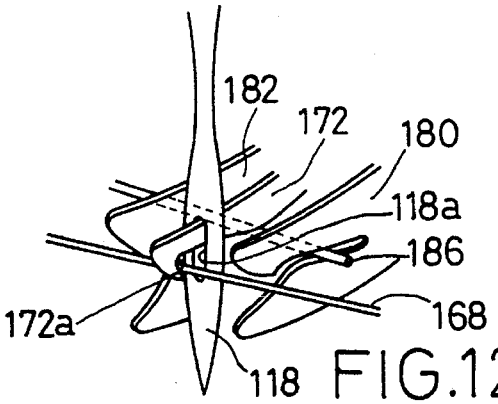
FIG.12C
PRIOR ART
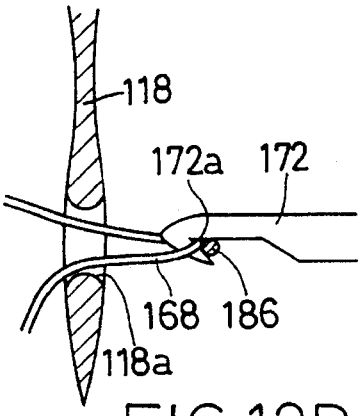
FIG.12D
PRIOR ART
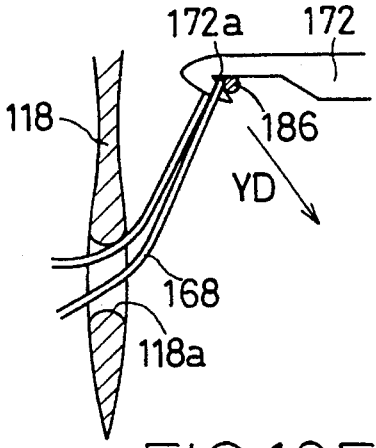
FIG.12E
PRIOR ART

THREADING APPARATUS OF SEWING MACHINE

BACKGROUND OF THE INVENTION

1. Field of the Invention

The present invention relates to a threading apparatus for putting a sewing thread through an eye hole of a sewing needle of a sewing machine.

2. Related Art Statement

There is known a threading device of a sewing machine which device includes a supporting member which is movable relative to a sewing needle and which supports a threading hook such that the hook can advance and retract through an eye hole of the needle. After a sewing thread fed to a position adjacent to the needle eye is caught by a notch of the hook advanced through the needle eye, the hook is retracted back through the needle eye. Thus, the sewing thread is put through the needle eye. The known threading device further includes an elastic member which biases the thread against the notch of the hook while the thread put through the needle eye is drawn out to make a thread loop. Thus, the thread put through the needle eye is securely held by the hook and the elastic member. This threading device is disclosed in Unexamined Japanese Patent Application laid open for inspection under Publication No. 3-143486.

The above prior threading device is described in more detail by reference to FIGS. 12(A) to 12(E).

As shown in FIG. 12(A), when a threading unit is located at an initial position thereof, i.e., an uppermost position thereof, a metal wire 186 as an elastic member of the threading unit is engaged with a notch 172*a* of a threading hook 172 such that the wire 186 is, in an initial state thereof, slightly elastically deformed and accordingly is biased or pressed against the front wall of the notch 172*a* provided in a tip portion of the hook 172. Subsequently, the threading unit is moved downward, so that an elevation level of the hook 172 is aligned with that of an eye hole 118*a* of a sewing needle 118, as shown in FIG. 12(B).

Then, a supporting bar (not shown) which extends parallel to a needle bar (not shown) to which the sewing needle 118 is secured, is rotated by a rotating device (not shown), so that the notch 172*a* of the hook 172 goes through the needle eye 118*a*, as shown in FIG. 12(C). When the notch 172*a* advances through the needle eye 118*a*, the wire 186 is elastically deformed by a stopper member (not shown) to move away from the notch 172*a* in a horizontal direction, so that the wire 186 is prevented from contacting the needle 118. Accordingly, the notch 172*a* advanced through the needle eye 118*a* catches a sewing thread 168 stretched in front of the needle eye 118*a*. Subsequently, the supporting bar is rotated back, and the hook 172 catching the thread 168 is retracted back through the needle eye 118*a* to draw the thread 168 through the eye hole 118*a* and make a loop of the thread 168. During this step, the wire 186 is again biased or pressed against the notch 172*a* of the hook 172 via the thread 168 being held therebetween. Thus, the thread 168 is securely held by the hook 172 and does not fall off the same 172.

When the threading unit is moved upward as shown in FIG. 12(E), the hook 172 draws the thread 168 through the needle eye 118*a* to provide a sufficient length or amount of the thread loop 168.

Thus, the prior threading device enjoys the advantage that the thread loop 168 does not fall off the hook 172 when being drawn through the needle eye 118*a* because the wire 186 as the elastic member biases the thread 168 against the notch 172*a* of the hook 172. However, since the wire 186 continues to press the thread 168 on the hook notch 172*a* even after a sufficient length or amount of the loop 168 is drawn through the needle eye 118*a*, as shown in FIG. 12(E), the prior threading device suffers from the following disadvantages: The thread 168 should finally be released from the hook 172 in order that a user may start sewing operation. To this end, however, the user is required to move the wire 186 in a direction away from the hook notch 172*a*. For example, the thread 168 should be pulled in a direction indicated at arrow, YD, in FIG. 12(E).

In many sewing machines, a threading hook 172 is moved from the rear side toward the front side to catch a sewing thread 168. As seen from the position of a user, the hook 172 is positioned in front of the wire 186 which cooperates with the hook 172 to sandwich the thread 168 therebetween. Therefore, the user is required to pull the thread 168 rearward as indicated at arrow YD. This is considerably difficult. If the user forcibly pulls the thread 168 in an erroneous direction such as in a downward or frontward direction, the hook 172 may even be damaged.

SUMMARY OF THE INVENTION

It is therefore an object of the present invention to provide a threading apparatus of a sewing machine wherein, when a sewing thread put through an eye hole of a sewing needle provides a sufficient length of thread loop, the thread is automatically or naturally released from a threading hook.

The above object has been achieved according to the present invention, which provides a threading apparatus for putting a sewing thread through an eye hole of a sewing needle of a sewing machine, comprising a threading hook including a hook portion which is movable through the eye hole of the sewing needle to catch the sewing thread positioned adjacent to the needle eye; a holding member which cooperates with the hook portion of the threading hook to hold the sewing thread caught by the hook portion; a biasing member which biases the holding member to press the sewing thread against the hook portion of the threading hook; a supporting member which supports the threading hook, the holding member, and the biasing member such that the threading hook, the holding member, and the biasing member are movable between a distant position thereof distant from the needle eye and a near position thereof near to the needle eye and are movable at the near position so that the hook portion of the threading hook advances and retracts through the needle eye to catch the sewing thread, draw the caught thread through the needle eye, and obtain a loop of the thread; and a releasing member which releases the sewing thread from the threading hook by moving the holding member away from the hook portion of the threading hook against the biasing action of the biasing member, at least one of the supporting member and the releasing member being movable relative to the other of the supporting member and the releasing member so that the holding member supported by the supporting member, and the releasing member are engaged with each other and the holding member is moved away from the hook portion of the threading hook against the biasing action of the biasing member.

In the threading apparatus constructed as described above, the biasing member biases the holding member to press the sewing thread against the hook portion (e.g., notch) of the threading hook when the hook portion catching the thread is retracted back through the needle eye. The holding member and the biasing member may be provided by a single elastic member such as a metal wire which functions as the two members. As the threading hook is moved from the near position thereof toward the distant portion thereof, the thread loop drawn through the needle eye becomes larger. The releasing member and/or the supporting member supporting the threading hook, the holding member, and the biasing member are/is moved relative to each other so that the releasing member and the holding member are engaged with each other and the releasing member moves the holding member away from the hook portion of the threading hook against the biasing action of the biasing member. Consequently the thread loop is naturally or automatically released from the hook so that a user or operator can pick up the thread loop. Since the biasing member biases the holding member to press the thread on the hook, the thread does not come or fall off the hook when being drawn through the needle eye to provide the thread loop. After a sufficient length or amount of the thread loop is obtained, the holding member is moved away from the hook portion of the threading hook against the biasing force of the biasing member, so that the thread is naturally released from the hook. Thus, the user is not required to release, with his or her fingers, the thread from the hook. This is very convenient and the operability of the sewing machine is improved. In addition, the problem that a user may forcibly pull a sewing thread in an erroneous direction and a threading hook may even be broken is solved.

According to a preferred feature of the present invention, the holding member and the biasing member are provided by an elastic member which cooperates with the threading hook to hold the sewing thread and presses the sewing thread against the threading hook, the releasing member releasing the sewing thread from the threading hook by elastically deforming the elastic member by an amount sufficient to release the sewing thread.

According to another feature of the present invention, the supporting member supports the threading hook such that the threading hook is movable along a movement route between a higher position as the distant position and a lower position as the near position and is movable at the lower position so that the hook portion thereof advances and retracts through the needle eye. When the hook catching the thread is moved upward from the lower position toward the higher or upper position, the thread tends to come off the hook portion mainly because an elastic force is produced in the thread so as to rotate the thread loop about the needle eye and thereby move the loop away from the hook portion. In order to prevent this, the biasing member and the holding member press, or the elastic member presses, the thread against the hook portion just after the thread is put through the needle eye.

According to yet another feature of the present invention, the releasing member has a guide surface which is fixed in the movement route of the threading hook against which the sewing thread is pressed by the holding member, the guide surface being inclined with respect to the movement route so that when the threading hook is moved along the movement route, the holding member is guided by the guide surface and is moved away from the hook portion of the threading hook. The holding member is moved on the inclined guide surface and accordingly is moved in a horizontal direction perpendicular to the direction in which the hook is moved along the movement route thereof. Thus, the holding member is moved away from the hook portion and the thread is released from the hook.

According to another feature of the present invention, the threading apparatus further comprises a moving device which moves the one of the supporting member and the releasing member relative to the other of the supporting member and the releasing member so that the holding member supported by the supporting member, and the releasing member are engaged with each other and the holding member is moved away from the hook portion of the threading hook against the biasing action of the biasing member. The releasing member may be moved by an exclusive moving device. On the other hand, in the case where the releasing member is fixed and a moving device for moving the supporting member between the distant and near positions is utilized to release the thread from the hook, the exclusive moving device for moving the releasing member is not needed, and the present threading apparatus enjoys a simpler construction.

According to another feature of the present invention, the moving device moves the supporting member supporting the threading hook against which the sewing thread is pressed by the holding member, so that the holding member is engaged with an inclined guide surface of the releasing member which is inclined with respect to a route of the movement of the threading hook by the moving device, and the holding member is moved away from the hook portion of the threading hook.

According to another feature of the present invention, the moving device comprises a laterally oscillating device of the sewing machine which laterally oscillates a needle bar to which the sewing needle is secured, so as to form zigzag stitches, the laterally oscillating device moving the supporting member relative to the releasing member. Thus, the threading apparatus in accordance with the present invention may be employed in not only a straight-stitch sewing machine but also a zigzag sewing machine.

According to another feature of the present invention, the releasing member is fixed to a frame member of the sewing machine. The frame member may be a cover member covering a sewing head of the sewing machine. Thus, the degree of freedom relating to the provision of the releasing member increases.

According to another feature of the present invention, the threading apparatus further comprises a base member which supports the supporting member and the releasing member. The supporting member may comprise a support bar which supports the threading hook, the holding member, and the biasing member, the support bar being supported by the base member such that the support bar is rotatable about an axis line thereof and is movable along the axis line relative to the base member, the releasing member being fixed to the base member. In the latter case, the base member, the support bar, the threading hook, the holding member, the biasing member, and the releasing member can be assembled in a common assembly line, and accordingly the accuracy of assembling of those elements is improved.

BRIEF DESCRIPTION OF THE DRAWINGS

The above and optional objects, features, and advantages of the present invention will better be understood by reading the following detailed description of the preferred embodiments of the invention when considered in conjunction with the accompanying drawings, in which:

FIG. 12(A) is an elevation view for illustrating a threading operation of a prior threading apparatus;

FIG. 12(B) is another elevation view for illustrating the threading operation of the prior threading apparatus;

FIG. 12(C) is a perspective view for illustrating the threading operation of the prior threading apparatus;

FIG. 12(D) is another elevation view for illustrating the threading operation of the prior threading apparatus; and FIG. 12(E) is another elevation view for illustrating the threading operation of the prior threading apparatus.

DETAILED DESCRIPTION OF THE PREFERRED EMBODIMENTS

Figure 1A:
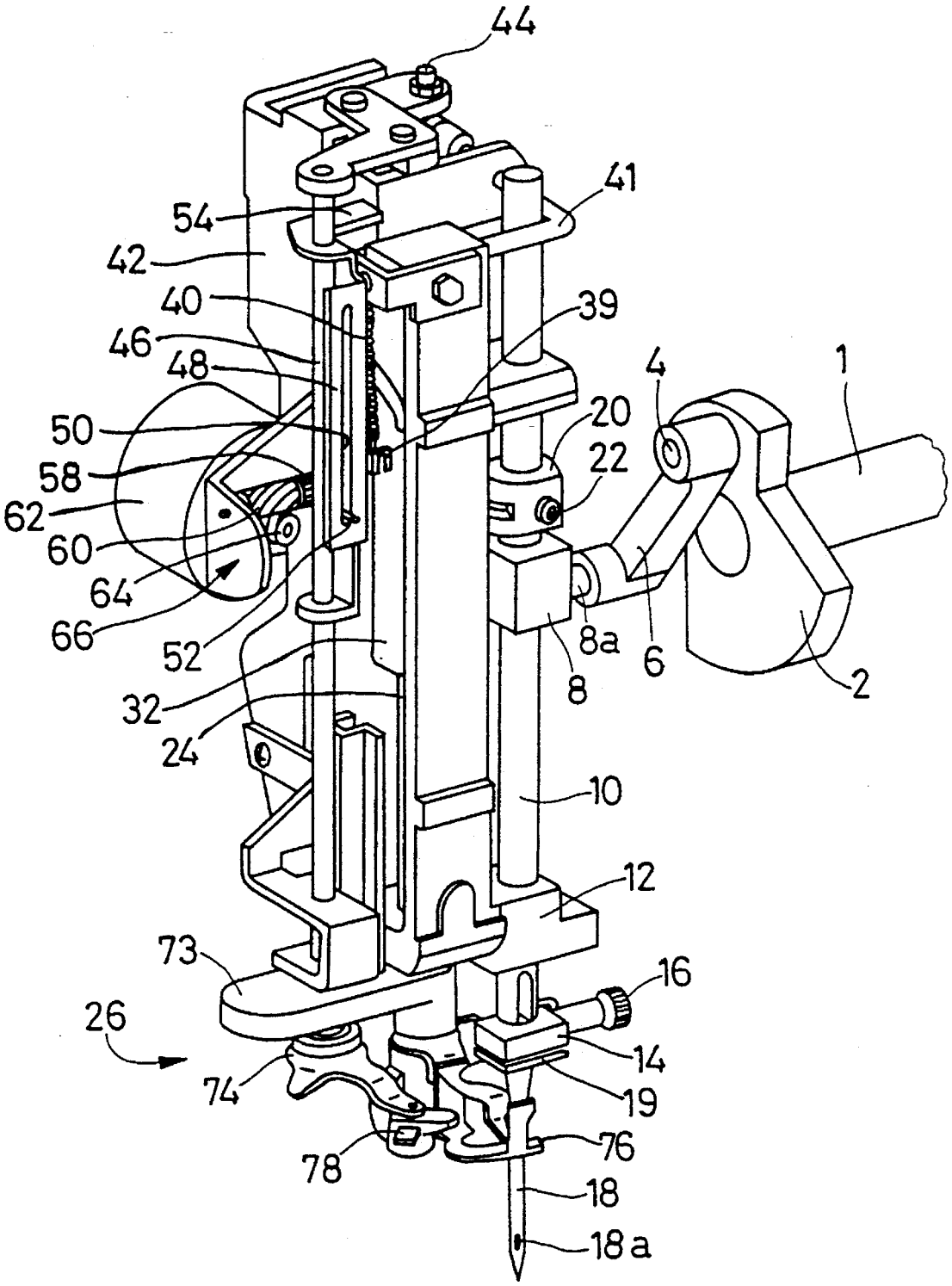
FIG. 1A is a perspective view of a threading apparatus of a straight-stitch sewing machine to which the present invention is applied.

Referring first to FIG. 1A, there is shown, as an embodiment of the present invention, a threading apparatus for putting a sewing thread 68 (FIG. 4) through an eye hole 18*a* of a sewing needle 18 of a sewing machine.

In FIG. 1A, reference numeral 1 designates an upper shaft which is driven or rotated by a main motor (not shown) of the sewing machine. A balance weight 2 is attached to the upper shaft 1, and a crank pin 4 extends from the balance weight 2. One end of a crank rod 6 fits on the crank pin 4 such that the crank rod 6 is rotatable about the crank pin 4. The other end of the crank rod 6 fits on a pin portion 8*a* of a needle-bar holder 8 such that the crank rod 6 is rotatable about the pin portion 8*a*. The needle-bar holder 8 is fixed to a needle bar 10.

Figure 2:
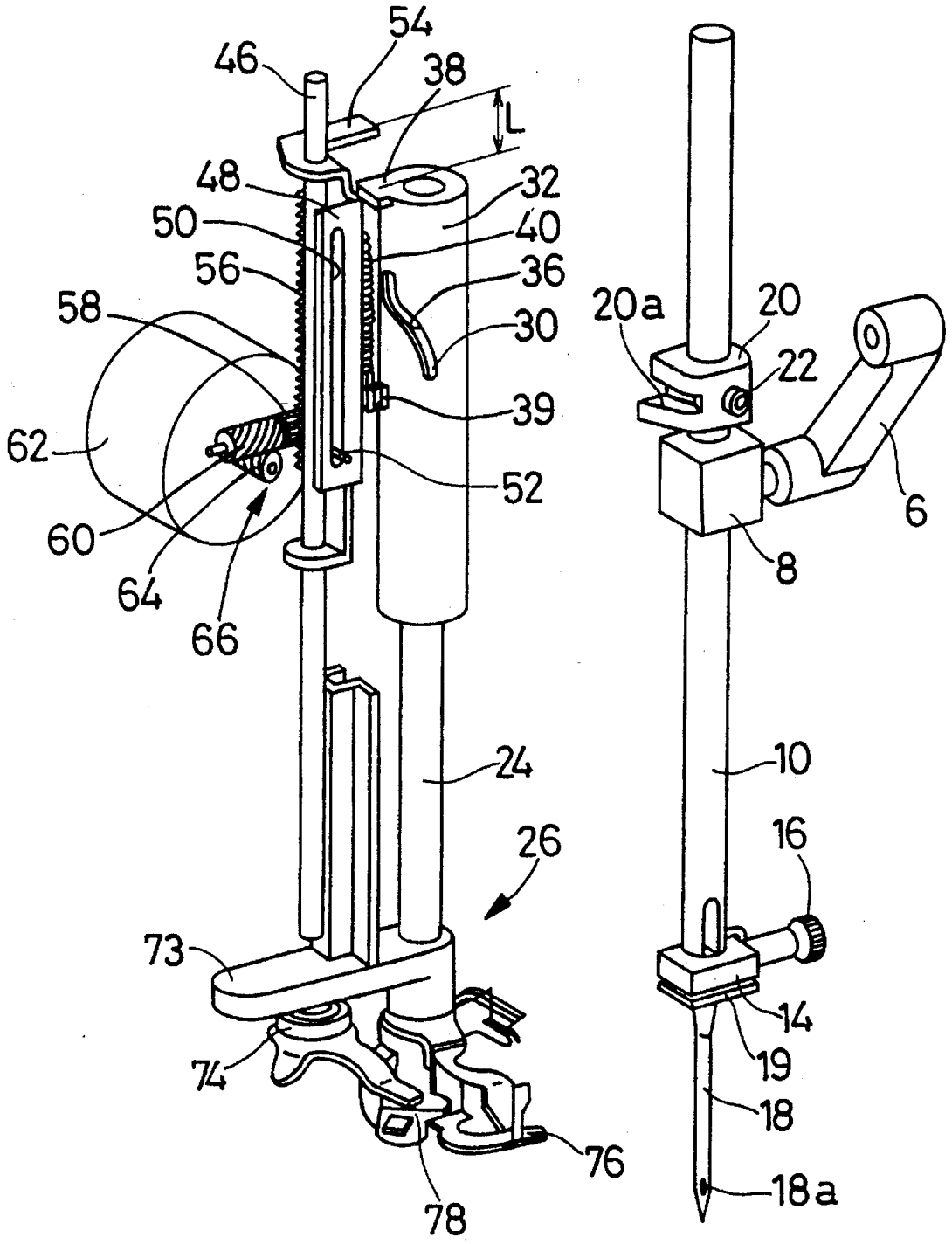
FIG. 2 is a perspective exploded view of a part of the threading apparatus of FIG. 1.
Figure 3:
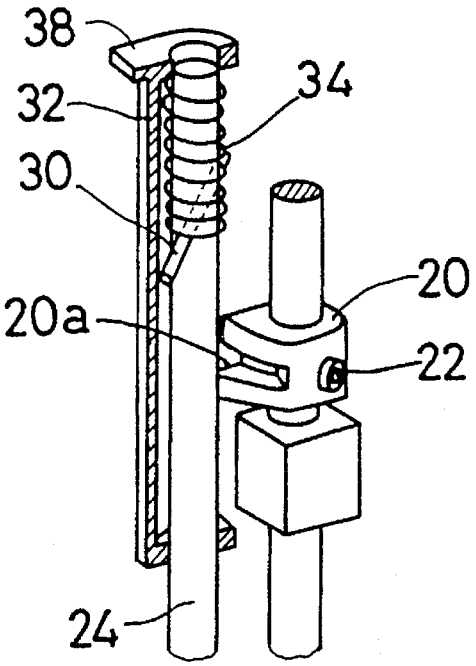
FIG. 3 is a perspective view of a part of the threading apparatus of FIG. 1 which part includes a positioning stopper.

The needle bar 10 is supported by a base member 12 such that the needle bar 10 is movable upward and downward relative to the base member 12. The base member 12 is fixed to a frame member (not shown) of the sewing machine, so that the base member 12 is immovable relative to an axis line of the upper shaft 1. A sewing needle 18 having an eye hole 18*a* is secured to a lower end of the needle bar 10 with the help of a needle holder 14 and a fastening screw 16. A thread guide 19 for guiding a sewing thread 68 (FIG. 4) is attached to the needle holder 14. A positioning stopper 20 is fixed with a screw 22 to the needle bar 10 at a prescribed position higher than a position of the needle-bar holder 8. As shown in FIGS. 2 and 3, the positioning stopper 20 includes a stopper surface 20*a* which extends perpendicularly to an axis line of the needle bar 10.

The base member 12 supports, in addition to the needle bar 10, a threading bar 24 such that the threading bar 24 extends parallel to the needle bar 10, is rotatable about an axis line thereof, and is movable upward and downward relative to the base member 12. A threading mechanism 26 (described in detail later) is attached to a lower end of the threading bar 24.

Figure 8A:
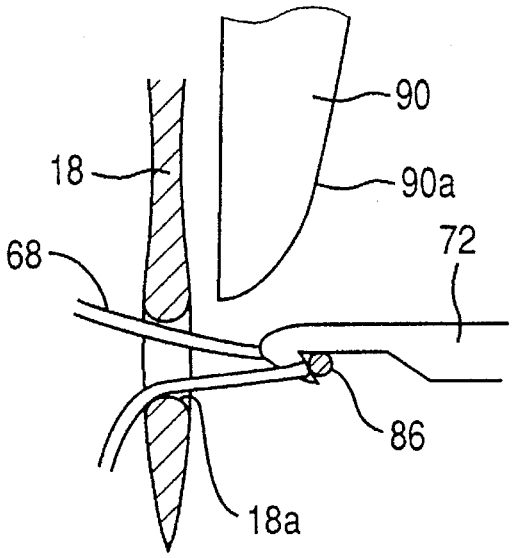
FIG. 8(A) is an elevation view for illustrating a threading operation of the threading apparatus of FIG. 1.

As shown in FIG. 3, an operative pin 30 is inserted in a diametric hole formed through an upper portion of the threading bar 24, and is fixed to the threading bar 24, so that the operative pin 30 extends diametrically through the threading bar 24. When the threading bar 24 is moved downward, the operative pin 30 abuts on the stopper surface 20*a* of the positioning stopper 20. The stopper 20 is fixed to the needle bar 10 with the screw 22 such that when the operative pin 30 abuts on the stopper surface 20*a*, a threading hook 72 (more specifically, a hook portion 72*a* thereof, each described later) is aligned with the eye hole 18*a* of the sewing needle 18, as shown in FIG. 8(A).

A hollow operative cylinder 32 fits on the upper end portion of the threading bar 24 such that the operative cylinder 32 is movable relative to the threading bar 24. A compression coil spring 34 is provided between the operative pin 30 and the cylinder 32. As shown in FIG. 2, the operative cylinder 32 has a guide groove 36 which generally extends along the axis line of the threading bar 24 and includes an arcuate portion. One end of the operative pin 30 is engaged with the guide groove 36. The operative cylinder 32 has, at an upper end thereof, an abutment portion 38 which extends radially of the threading bar 24. The operative cylinder 32 also has a first spring seat 39 on an outer circumferential surface thereof, and a biasing spring 40 is provided between the first spring seat 39 and a second spring seat (not shown) integrally formed with a movable member 48 (described in detail later). Thus, the movable member 48 is biased upward by the biasing spring 40.

As shown in FIG. 1A, one end of an L-shaped support member 41 is inserted in an upper end portion of the base member 12, such that the one end of the support member 41 is rotatable and is prevented from coming out of the upper end portion of the base member 12. The other end of the support member 41 is inserted in a support frame 42 fixed to the frame member (not shown) of the sewing machine such that the other end of the support member 41 is rotatable and is prevented from coming out of the support frame 42 by a screw 44. A guide bar 46 is fixed to the support frame 42 such that the guide bar 46 extends parallel to the threading bar 24. The movable member 48, separate from the operative cylinder 32, fits on the guide bar 46 such that the movable member 48 is movable on the guide bar 46.

The movable member 48 has a groove 50 which extends along an axis line of the guide bar 46. A pin 52 extending from the guide bar 46 is engaged with the groove 50, so that the movable member 48 is prevented from being rotated relative to the guide bar 46. The movable member 48 has, at an upper end thereof, a protruding portion 54 which extends toward the operative cylinder 32 and is abutable on the abutment portion 38 of the cylindrical member 32. In the present embodiment, when the movable member 48 is located at an uppermost position thereof shown in FIG. 2, a prescribed distance, L, is provided between the protruding portion 54 of the movable member 48 and the abutment portion 38 of the operative cylinder 32. However, the distance L may be zero, i.e., when the movable member 48 is located at the uppermost position, the protruding portion 54 may be in contact with the abutment portion 38.

The movable member 48 has a rack portion 56 which extends along the axis line of the guide bar 46. A pinion 58 which is rotatably supported by the support frame 42 is engaged with the rack portion 56 of the movable member 48. The pinion 58 is integral with a helical gear 60 which is engaged with a worm gear 64 fixed to an output shaft of a stepper motor 62 secured to the support frame 42. The worm gear 64, helical gear 60, pinion 58, and rack portion 56 cooperate with one another to provide a transmission mechanism 66.

When the stepper motor 62 is driven or rotated forward, the movable member 48 is moved downward. When the movable member 48 is moved downward by the distance L, the protruding portion 54 of the movable member 48 abuts on the abutment portion 38 of the operative cylinder 32, so that the operative cylinder 32 is moved downward and accordingly the threading bar 24 is moved downward via the compression spring 34 and the operative pin 30. Consequently the threading mechanism 26 supported by the threading bar 24 is moved downward.

When the threading bar 24 is lowered, the operative pin 30 is lowered and eventually the previously described other end of the operative pin 30 abuts on the stopper surface 20*a* of the positioning stopper 20 fixed to the needle bar 10. In this situation, the rotation of the upper shaft 1 is stopped and accordingly the vertical reciprocation of the needle bar 10 is stopped via the crank rod 6 and the needle-bar holder 8. Thus, the threading bar 24 is inhibited from being further lowered, i.e., is stopped at a lowermost position thereof. With the further lowering of the threading bar 24 being thus inhibited, however, the movable member 48 is further lowered and the operative cylinder 32 is further lowered against the elastic action of the compression spring 34. Consequently the operative pin 30 is moved or rotated by being guided by the guide groove 36 of the cylinder 32. Thus, the threading bar 24 is rotated via the operative pin 30.

When the threading bar 24 is thus rotated in a forward direction and subsequently in a backward direction, the threading mechanism 26 operates, as described below, for putting the sewing thread 68 through the eye hole 18*a* of the sewing needle 18.

Figure 4:
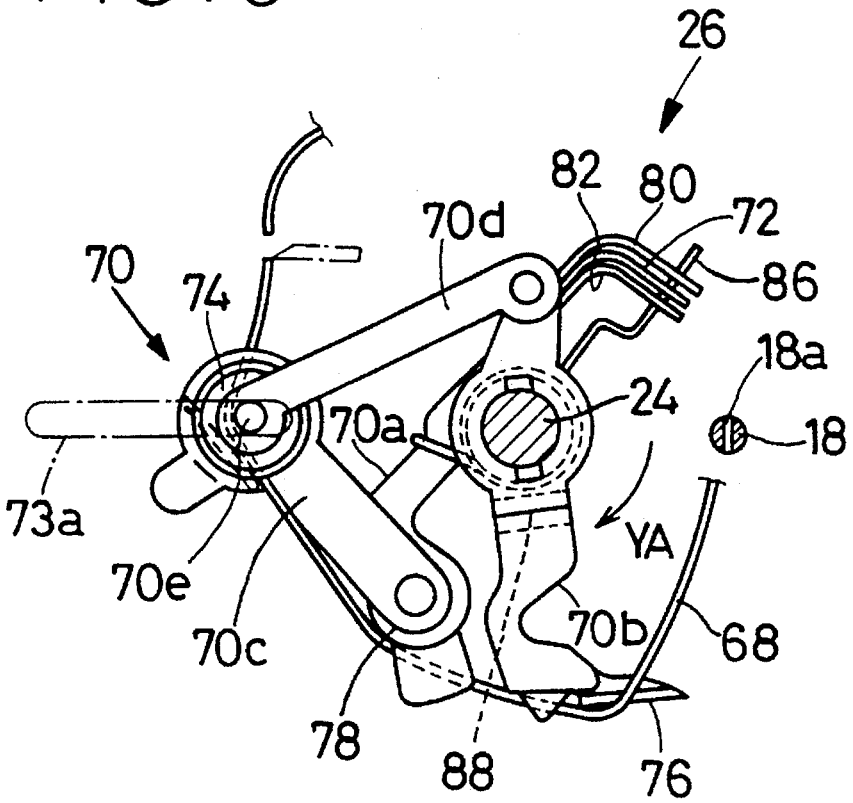
FIG. 4 is a plan view of an essential part of the threading apparatus of FIG. 1 which part is placed in a first operative state thereof.

As shown in FIG. 4, the threading mechanism 26 includes a link mechanism 70 and a threading hook 72. When the threading bar 24 is rotated in a forward direction indicated at arrow, YA, the link mechanism 70 operates for stretching the sewing thread 68 in front of the needle eye 18*a*, and the threading hook 72 is rotated with the threading bar 24 in the same direction YA toward a rear side of the needle eye 18*a*.

The link mechanism 70 includes a first, a second, a third, and a fourth link member 70*a*, 70*b*, 70*c*, 79*d*. The first link 70*a* is fixed to the threading bar 24 and is rotated therewith. The second link 70*b* is supported by the threading bar 24 such that the second link 70*b* is rotatable about the bar 24. The third and fourth links 70*c*, 70*d* are provided between the first and second links 70*a*, 70*b*. A connecting pin 70*e* which connects the third and fourth links 70*c*, 70*d* fits in a guide groove 73*a* formed in a link guide 73 such that the connecting pin 70*e* is movable relative to the link guide 73. The link guide 73 fits on a lower end portion of the threading bar 24 such that the bar 24 is rotatable relative to the link guide 73, and the link guide 73 is supported by the support frame 42 such that the link guide 73 is movable upward and downward together with the threading bar 24.

Figure 5:
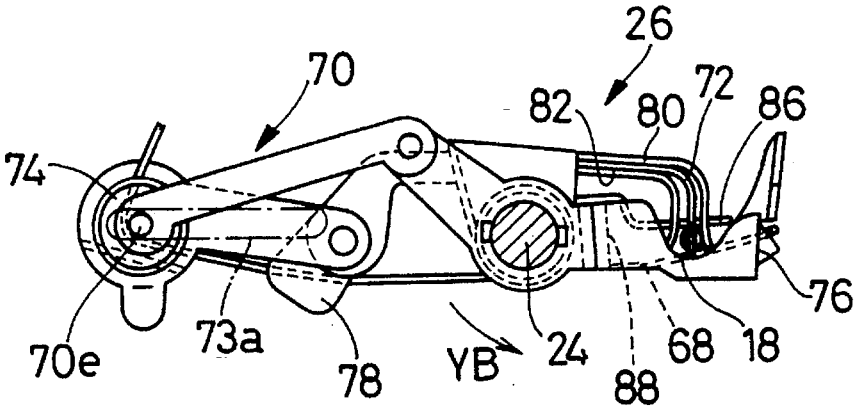
FIG. 5 is a plan view of the essential part of the threading apparatus of FIG. 1 which part is placed in a second operative state thereof.

The link mechanism 70 supports a thread holding device 74, a first thread guiding device 76, and a second thread guiding device 78. The thread holding device 74 is provided coaxially with the connecting pin 70*e* connecting the third and fourth links 70*c*, 70*d*, and holds an end portion of the sewing thread 68 with a prescribed holding force. The first guiding device 76 is provided at a free end of the second link 70*b*, and guides the sewing thread 68 supplied via the thread guide 19 fixed to the needle bar 10. The second guiding device 78 is provided coaxially with a pin connecting the first and third links 70*a*, 70*c*, and guides the sewing thread 68 between the first guiding device 76 and the thread holding device 74. As shown in FIG. 5, when the threading bar 24 is rotated in the direction YA, the first and second guiding devices 76, 78 and the thread holding device 74 cooperate with one another to stretch the sewing thread 68 in front of the eye hole 18*a* of the sewing needle 18 such that the sewing thread 68 has a predetermined length between the needle eye 18*a* and the thread holding device 74.

Figure 6:
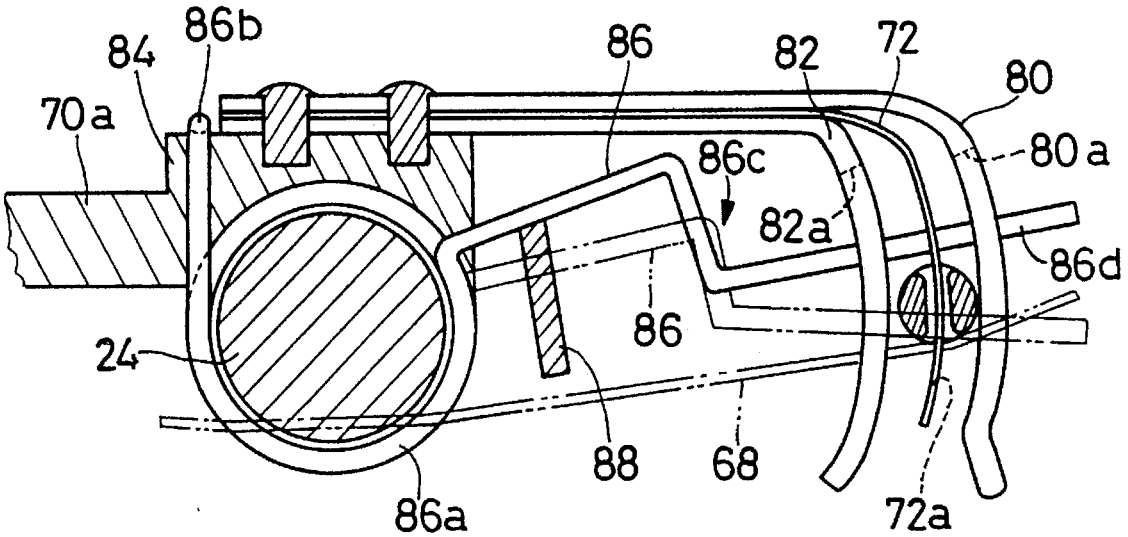
FIG. 6 is an enlarged plan view of the essential part of the threading apparatus of FIG. 1 which part is placed in the second operative state shown in FIG. 5.

The threading hook 72 which is swung toward the needle eye 18*a* is protected by a pair of plate-like hook guard members 80, 82 which are provided on both sides of the threading hook 72 in a horizontal plane with appropriate spacings being provided therebetween. As shown in FIG. 6, the threading hook 72 and the guard plates 80, 82 are fixed to a support block 84 secured to the first link 70*a* of the link mechanism 70.

Figure 7:
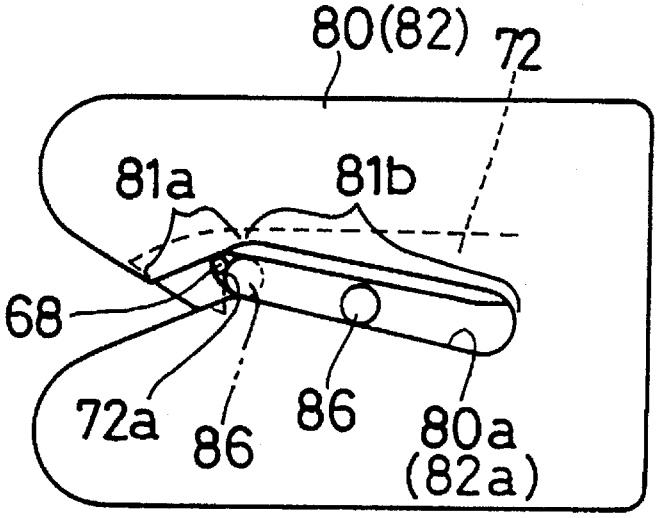
FIG. 7 is an elevation view of a hook guard of a hooking device of the threading apparatus of FIG. 1.

FIG. 7 is a right-side elevation view of the hook guard plates 80, 82 shown in FIG. 6. The guard plates 80, 82 have respective guide grooves 80*a*, 82*a*. Each guide groove 80*a*, 82*a* includes a front portion 81*a* which is so shaped as to guide the sewing thread 68 into a hook portion or notch 72*a* of the threading hook 72, and additionally includes a rear portion 81*b* which is so shaped as to align with a lower face of the threading hook 72. Thus, each guide groove 80*a*, 82*a* is curved at an intermediate portion thereof where the front portion 81*a* ends and the rear portion 81*b* begins.

As shown in FIG. 6, a coiled portion 86*a* of an elastic metal wire 86 is partially wound around the threading bar 24 which supports the threading hook 72 and the hook guards 80, 82 via the support block 84. The elastic wire 86 operates as both a holding member and a biasing member for biasing the holding member against the notch 72*a* of the threading hook 72. One end 86*b* of the metal wire 86 is rectangularly bent and is secured to the support block 84. The elastic wire 86 further includes a stepped intermediate portion 86*c*, and an end portion 86*d* which is inserted in the respective guide grooves 80*a*, 82*a* of the guard plates 80, 82 as shown in FIG. 7. As indicated in two-dot chain lines in FIGS. 6 and 7, the elastic wire 86 is pressed with a prescribed biasing force against the notch 72*a* of the threading hook 72.

As shown in FIGS. 4, 5, and 6, a plate-like stopper member 88 is fixed to a base portion of the second link 70*b*, which is rotated in a direction indicated at arrow, YB, in FIG. 5, toward a front side of the needle eye 18*a*, when the elastic wire 86 is moved toward the rear side of the needle eye 18*a*.

When the threading hook 72 and the second link 70*b* are moved toward the needle eye 18*a* in the opposite directions YA, YB, respectively, the stopper member 88 abuts on the stepped portion 86*c* of the elastic wire 86 just before the wire 86 abuts on the sewing needle 18, thereby inhibiting the wire 86 from abutting on the needle 18. Thus, the wire 86 which normally is pressed on the notch 72*a* of the threading hook 72 is elastically deformed and moved away from the notch 72*a* of the hook 72, when the notch 72*a* goes through the needle eye 18*a*.

After the movement of the elastic wire 86 is inhibited by the stopper member 88, the threading hook 72 and the second link 70*b* are further moved toward the needle eye 18*a* in the opposite directions, respectively, so that the wire 86 is elastically deformed by the stopper member 88, is moved away from the notch 72*a* of the threading hook 72, and is guided into the rear portions 81*b* of the guide grooves 80*a*, 82*a* of the guard plates 80, 82. Thus, the elastic wire 86 takes a position indicated in solid lines in FIGS. 6 and 7.

Figure 8B:
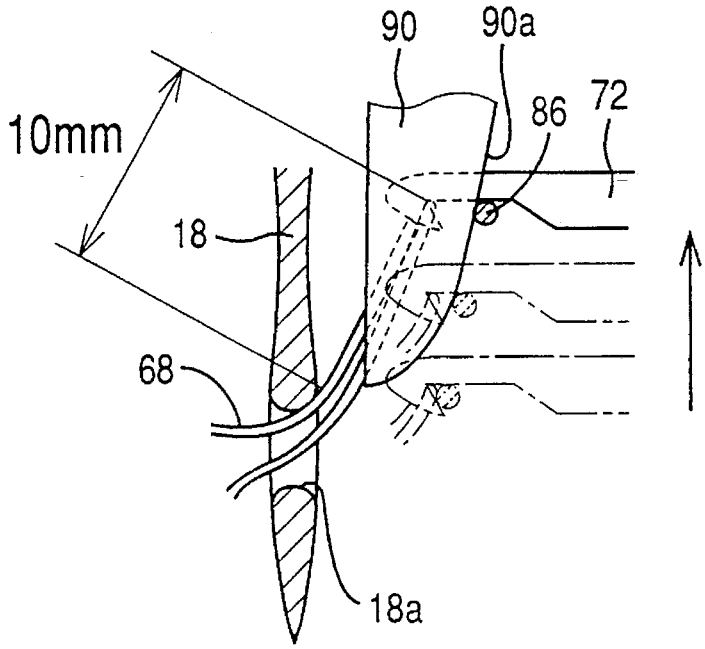
FIG. 8(B) is another elevation view for illustrating the threading operation of the threading apparatus of FIG. 1.
Figure 9A:
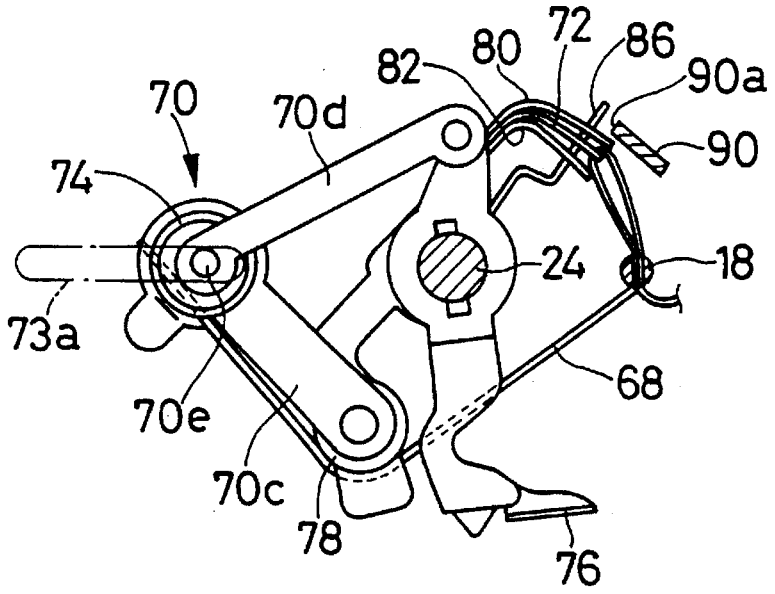
FIG. 9(A) is a plan view for illustrating the threading operation of the threading apparatus of FIG. 1.
Figure 9B:
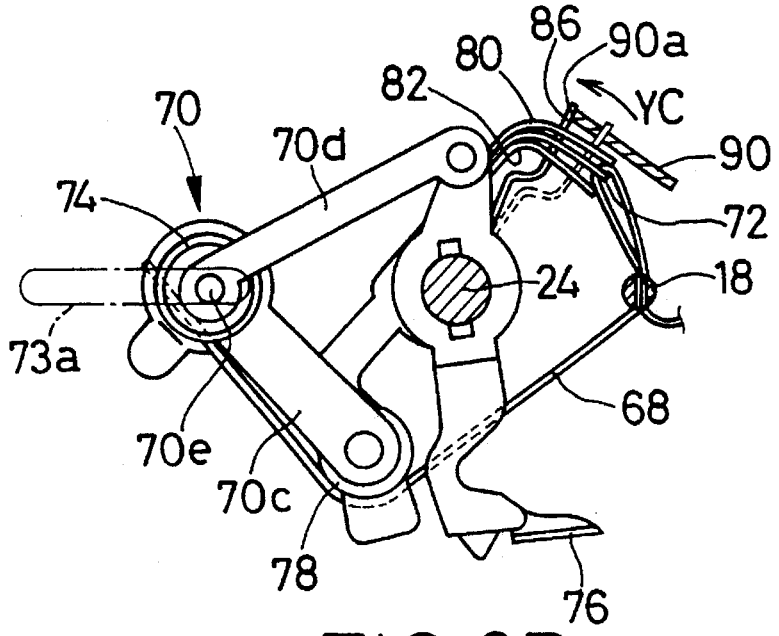
FIG. 9(B) is another plan view for illustrating the threading operation of the threading apparatus of FIG. 1.

Next, there will be described a thread releasing member 90 provided as a characteristic element of the present threading apparatus. The releasing member 90 is fixed to the base member 12. As shown in FIGS. 8(A) and 8(B), the releasing member 90 is a plate-like flat member having a generally triangular shape whose width decreases in a downward direction. As shown in FIGS. 9(A) and 9(B), the releasing member 90 is provided in rear of the sewing needle 18, and extends generally perpendicularly to the direction of extension of the elastic wire 86.

As shown in FIGS. 8(A) and 8(B), the releasing member 90 has a guide surface 90*a* which is provided midway in a route of movement of the threading hook 72 and the elastic wire 86 when the threading bar 24 is moved downward and upward between the uppermost and lowermost positions thereof by the stepper motor 62. The guide surface 90*a* is inclined with respect to the movement route of the elastic wire 86 for biasing the sewing thread 68 against the notch 72*a* of the hook 72. The guide surface 90*a* is designed to have a shape satisfying the following conditions: when the elastic wire 86 currently biasing the sewing thread 68 against the notch 72*a* of the hook 72 is moved upward together with the threading hook 72, the wire 86 is engaged with the guide surface 90*a* of the releasing member 90 and is elastically deformed by the guide surface 90*a*, so that the wire 86 is moved away from the notch 72*a* in a horizontal direction and, when the sewing thread 68 drawn out through the needle eye 18*a* mounts to a predetermined amount or length, the elastic deformation of the wire 86 exceeds an amount ensuring that the wire 86 stops biasing the thread 68 against the notch 72*a* of the hook 72.

More specifically described, the threading hook 72 is moved upward together with the elastic wire 86, from the lowermost position thereof shown in FIG. 8(A) where the hook 72 and the wire 86 are adjacent to the needle eye 18*a*, to a vertical-direction position indicated in solid lines in FIG. 8(B). At this position or elevation level, the wire 86 is located at a horizontal-direction position away from the notch 72*a* of the hook 72 by a prescribed distance where the wire 86 stops biasing the thread 68 against the hook notch 72*a*. The position of the threading hook 72 indicated in solid lines in FIG. 8(B) is somewhat lower than the uppermost position of the hook 72 that is the same as the initial position of the threading mechanism 26.

The above-indicated predetermined amount of the sewing thread 68 which is drawn out through the needle eye 18*a* before the elastic wire 86 stops biasing the thread 68 against the hook notch 72*a*, is equal to a length ensuring that a user of the sewing machine can pick up a loop of the thread 68 drawn from the needle eye 18*a* with his or her fingers, for example, the thread length being equal to about 10 mm. As the releasing member 90 is provided at a higher position, or a more distant position, relative to the needle eye 18*a*, in the movement route of the threading hook 72 or the elastic wire 86, the above-indicated length of the thread loop 68 increases. On the other hand, as the releasing member 90 is provided at a lower position or a nearer position relative to the needle eye 18*a* in the same route, the above-indicated length of the thread loop 68 decreases.

Figure 1B:
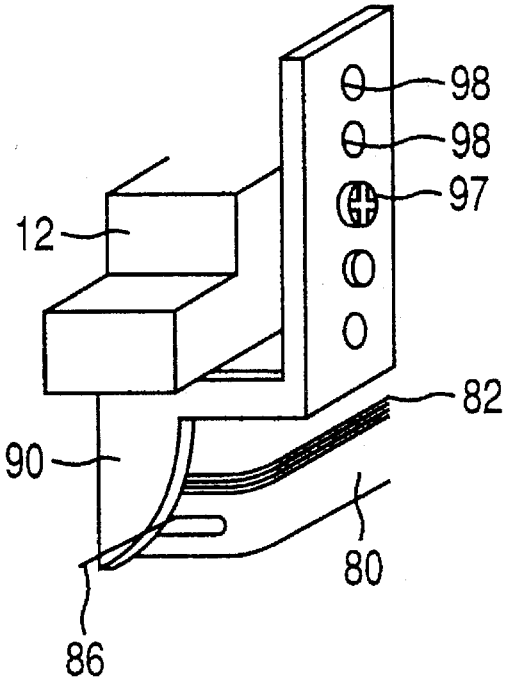
FIG. 1B is a perspective view showing a thread releasing member of the threading apparatus of FIG. 1.

The thread releasing member 90 is secured to the base member 12 by threading a screw 97 into one of a plurality of threaded holes 98 having different vertical-direction and/or horizontal-direction positions as shown in FIG. 1B. Thus, the releasing member 90 can be adjusted to user's desired vertical-direction and/or horizontal-direction positions, so that the length of the thread loop 68 can be adjusted to a user's desired value at which he or she can easily pick up the thread loop 68. Since the length of the thread loop 68 can be adjusted to a minimum value, the amount of consumption of the sewing thread 68 can be minimized.

Figure 1C:
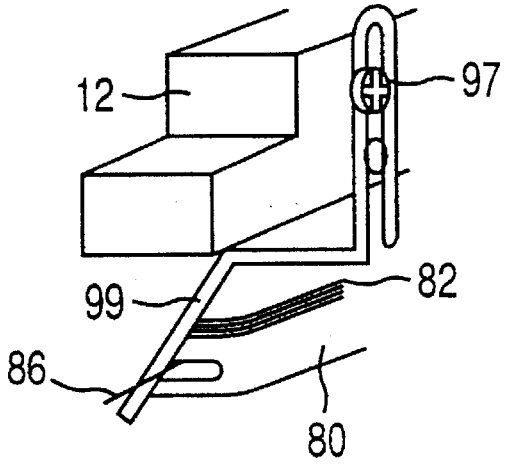
FIG. 1C is a perspective view showing another thread releasing member of the threading apparatus of FIG. 1.

Although in the present embodiment the thread releasing member 90 is provided by a flat plate, the releasing member 90 may be provided by such a material which has a shape easily deformable by user's fingers and can maintain the deformed shape; for example, a metallic wire 99 as shown in FIG. 1C. This wire 97 is required to have a sufficiently great strength which can elastically deform the elastic metal wire 86. In this case, the length of the thread loop 68 can easily be changed as desired.

Hereinafter, there will be described the threading operation of the threading apparatus constructed as described above.

After the threading mechanism 26 is moved downward to the lower most position thereof, the link mechanism 70 is operates such that the notch 72*a* of the threading hook 72 goes or advances through the needle eye 18*a* by a prescribed distance while the elastic wire 86 is inhibited from contacting the sewing needle 18. Simultaneously, as shown in FIG. 5, the sewing thread 68 stretched out in front of the needle eye 18*a* is guided by the respective front portions 81*a* of the guide grooves 80*a*, 82*a* of the hook guard plates 80, 82, so that the thread 68 is caught by the hook notch 72*a*.

Subsequently, the stepper motor 62 is rotated reversely and the threading bar 24 is rotated back in the direction YB, the threading hook 72 and the second link 70*b* are moved away from the needle eye 18*a* in opposite directions, respectively. Consequently the threading hook 72 currently catching the sewing thread 68 retracts through the needle eye 18*a*. Subsequently, the elastic wire 86 is moved away from the stopper member 88, so that the wire 86 biases or presses the caught thread 68 against the notch 72*a* of the hook 72. While the threading bar 24 is further rotated from this state in the direction YB shown in FIG. 8(A), i.e., while the bar 24 is returned to the state shown in FIG. 9(A), which is taken before being rotated in the direction YA, the threading hook 72 is retracted away from the needle eye 18*a* while holding the sewing thread 68 in the notch 72*a*. Accordingly, the sewing thread 68 is drawn through the needle eye 18*a* to provide a loop of the thread 68. In this state, the elastic wire 86 has not been engaged with the guide surface 90*a* of the thread releasing member 90, yet, as shown in FIGS. 8(A) and 9(A).

As the threading hook 72 is moved upward from the lower most position toward the uppermost position, the loop of the sewing thread 68 drawn from the needle eye 18*a* becomes bigger.

While the threading hook 72 currently holding the sewing thread 68 is moved upward, the thread releasing member 90 is engaged with the elastic wire 86 currently pressing the thread 68 against the notch 72*a* of the hook 72 and elastically deforms the wire 86 so that the wire 86 stops pressing the thread 68 against the hook notch 72*a* when a predetermined amount of the thread 68 in the form of a loop is drawn through the needle eye 18*a*. Consequently the sewing thread 68 is released from the notch 72*a* of the threading hook 72.

Next, there will be described in detail the process in which the sewing thread 68 is released from the threading hook 72.

In the present embodiment, the thread releasing member 90 has the guide surface 90*a* which is inclined with respect to the route of movement of the threading hook 72 between the uppermost and lowermost positions thereof. While the threading hook 72 is moved by the stepper motor 62 from the state shown in FIG. 8(A), upward along the movement route thereof, relative to the releasing member 90, the elastic wire 86 presses, for a while, the sewing thread 64 against the hook portion or notch 72*a* of the hook member 72. Subsequently, however, the wire 86 is engaged with the inclined guide surface 90*a* of the releasing member 90, as indicated in two-dot chain lines in FIG. 8(B), so that the wire 86 is also moved in a horizontal direction.

When the threading hook 72 is further moved upward, only the elastic wire 86 is guided by the inclined guide surface 90*a* of the thread releasing member 90, so that the wire 86 is moved in the right direction in FIG. 8(B), i.e., in a direction indicated at arrow, YC, in FIG. 9(B). Consequently the wire 86 is moved away from the notch 72*a* of the threading hook 72 by a predetermined distance, as indicated in solid lines in FIG. 8(B). FIG. 9(B) shows the same state of the elastic wire 86. Since in this state the wire 86 no longer presses the sewing thread 68 against the notch 72*a* of the hook 72, the sewing thread 68 can be released from the notch 72*a* or the hook 72. When the threading hook 72 is further moved upward toward the uppermost position thereof with the elastic wire 86 being positioned away from the notch 72*a*, the sewing thread 68 is naturally released from the notch 72*a* of the hook member 72, because of the gravity exerted thereto and the elastic force of the thread 68 to rotate the loop about the needle eye 18*a*.

As is apparent from the foregoing description, in the present embodiment, the elastic wire 86 presses or biases the sewing thread 68 against the notch 72*a* of the threading hook 72. Therefore, when a loop of the sewing thread 68 is drawn out through the needle eye 18*a*, the sewing thread 68 does not come off the hook member 72. In addition, when the length of the thread loop 68 increases up to a predetermined value, the thread loop 68 naturally comes off the hook member 72. Thus, the user need not do the work of releasing, with his or her fingers, the thread loop 68 from the hook member 72. Thus, the present sewing machine is very convenient. The user is freed from the difficult work needed in the conventional sewing machine to draw, with his or her fingers, the sewing thread 168 in the direction YD shown in FIG. 10(E), for releasing the sewing thread 168 from the threading hook 172. The present threading apparatus is also free from the conventional problem that a user may make an error to forcibly draw the sewing thread 168 downward or frontward, thereby even damaging the threading hook 172 by which the sewing thread 168 is held.

While the present invention has been described in its preferred embodiment, the present invention may otherwise be embodied.

For example, in the illustrated embodiment, the elastic wire 86 is used to press the sewing thread 68 against the notch 72*a* of the threading hook 72. However, the elastic wire 86 may be replaced by a holding member (e.g., a lever) rotatably supported by the threading bar 24, and a biasing member (e.g., spring) for biasing the holding member to press the sewing thread 68 against the notch 72*a*. That is, it can be said that in the illustrated embodiment the elastic wire 86 functions as both the holding member and the biasing member.

Although in the illustrated embodiment the metal wire 86 as an elastic member is moved by the stepper motor 62 relative to the thread releasing member 90 so that the wire 86 is elastically deformed by an amount sufficient to release the sewing thread 86 from the notch 72*a* of the threading hook 72, an exclusive moving device (e.g., an electric motor) may be employed to move the releasing member 90 relative to the elastic wire 86 to engage the wire 86 and thereby elastically deform the same 86. In the latter case, however, the employment of the exclusive moving device results in making the construction of the threading apparatus more complex. Since the stepper motor 62 has conventionally been employed to thread the sewing needle 18, the illustrated threading apparatus does not need any additional, exclusive drive means for releasing the elastic wire 86 from the threading hook 72 after a predetermined length of the thread loop 68 is drawn out through the needle eye 18*a*.

In the illustrated threading apparatus, the stopper member 88 is employed to inhibit the elastic wire 86 from contacting the sewing needle 18, thereby preventing the needle 18 from being bent by the wire 86. In this respect, too, the reliability of the sewing machine and the efficiency of the sewing operation are improved.

In the illustrated embodiment, the threading hook 72, the elastic wire 86, the threading bar 24 (i.e., supporting bar or member), and the thread releasing member 90 are all supported by the base member 12. The base member 12 also functions as a needle-bar supporting member which supports the needle bar 10 to which the sewing needle 18 is secured. This arrangement provides the following advantages: Since the threading hook 72, elastic wire 86, threading bar 24, and thread releasing member 90 are assembled in a common assembly line, the accuracy of assembling of those elements is improved. On the other hand, if the assembly line should be extended, the efficiency of assembling of a sewing machine as a whole is lowered. In the case where the releasing member 90 is fixed to the base member 12 which supports the hook 72, wire 86, and threading bar 24, the assembling of sewing machines can be carried out in divided assembly lines one of which is directed to the assembling of the hook 72, wire 86, threading bar 24, and base member 12 and the others of which are directed to the assembling of the other components or parts. Thus, the accuracy of assembling of the hook 72, wire 86, threading bar 24, and base member 12 is improved and the efficiency of assembling of a sewing machine as a whole is also improved.

Figure 10:
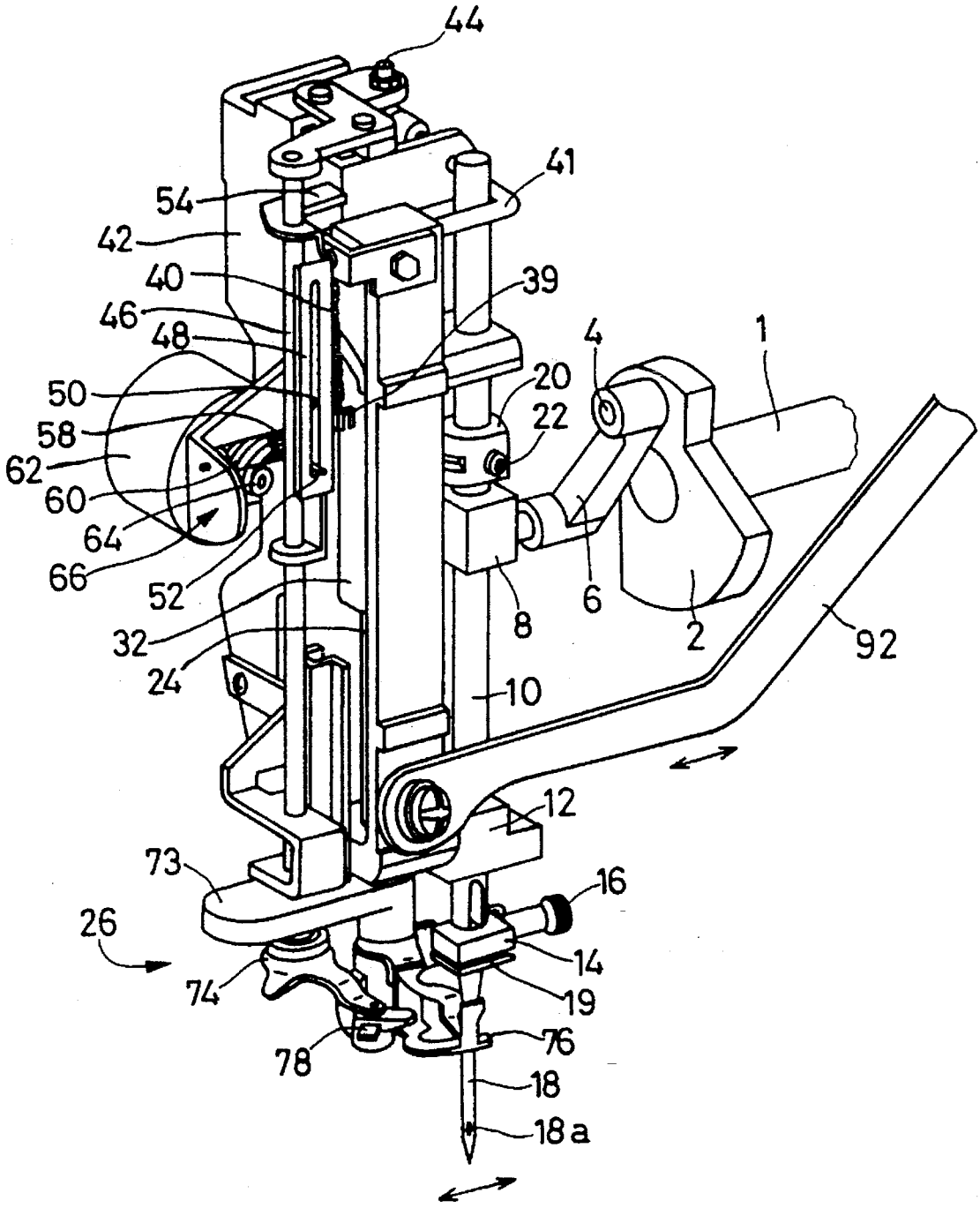
FIG. 10 is a perspective view corresponding to FIG. 1, showing another threading apparatus of a zigzag sewing machine as a second embodiment of the present invention.
Figure 11:
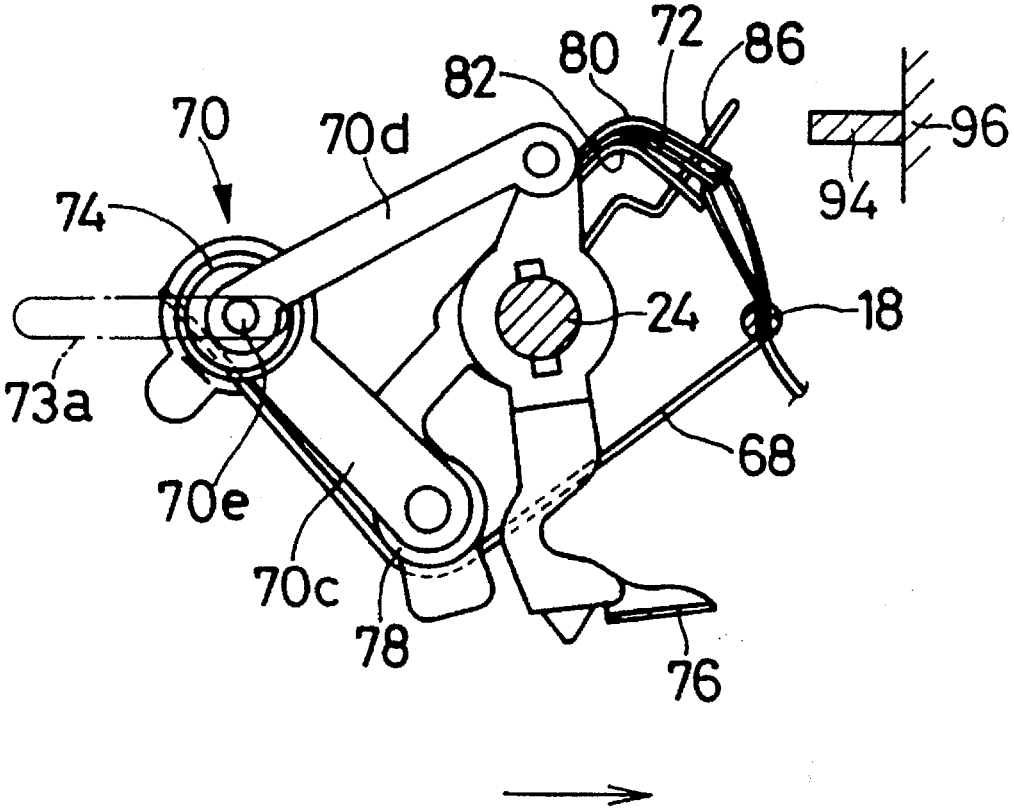
FIG. 11 is a plan view corresponding to FIG. 9(A), illustrating a threading operation of the threading apparatus of FIG. 10.

Referring next to FIGS. 10 and 11, there is shown another embodiment of the present invention. The second embodiment relates to a zigzag sewing machine which has a construction basically similar to that of the straight-stitch sewing machine as the first embodiment shown in FIGS. 1 to 9(B) and additionally includes a Z-shaped link 92 which is connected to a swinging device (not shown) for laterally oscillating a base member 12 which supports a threading hook 72, an elastic wire 86, a threading bar 24, and a needle bar 10.

In the second embodiment, when the swinging device laterally swings the base member 12 via the Z-shaped link 92, a threading unit or mechanism 26 including the threading hook 72, elastic wire 86, and threading bar 24 is also swung laterally as indicated at arrows in FIGS. 10 and 11. In the case where a thread releasing member is supported by the base member 12 like in the first embodiment, a position of the releasing member relative to the threading mechanism 26 does not change when the base member 12 is swung by the swinging device, because the releasing member 90 and the base member 12 are moved together. Thus, the zigzag sewing machine may employ a thread releasing member identical with the releasing member 90 employed in the straight-stitch sewing machine shown in FIGS. 1 to 9(B).

Alternatively, as shown in FIG. 11, a thread releasing member 94 may be fixed to an inner surface of a frame member 96 (e.g., lateral cover member or bottom base member) of the zigzag sewing machine. In this case, after a predetermined length or amount of a thread loop 68 is drawn out through an eye hole 18*a* of a sewing needle 18 while the threading hook 72 is moved upward by a stepper motor 62, the base member 12 is swung by the swinging device so that the elastic wire 86 currently pressing the sewing thread 68 against a notch 72*a* of the hook member 72 is engaged with the releasing member 94 fixed to the frame member 96 and is elastically deformed by an amount sufficient to release the thread 68 because of the gravity exerted to the thread 68 and the elastic force of the thread 68 to rotate the loop 68 about the needle eye 18*a*.

Moreover, a large-size thread releasing member may be employed and fixed to the frame member 96. This releasing member has so great a dimension to be able to engage the elastic wire 86 even when the threading hook 72 holding the thread loop 68 is moved upward in the state in which the base member 12 is swung a maximum angle to the right or left end position thereof. In this case, too, when the hook member 72 is moved upward, the wire 86 is engaged with an inclined guide surface of the releasing member so that the wire 86 is elastically deformed and moved in a horizontal direction and, when a predetermined length of the thread loop 68 is obtained, the wire 86 releases the thread 68, which naturally or automatically falls off the notch 72*a* of the hook member 72.

It is to be understood that the present invention may be embodied with other changes, improvements, and modifications that may occur to those skilled in the art without departing from the scope and spirit of the invention defined in the appended claims.

What is claimed is:

1. A threading apparatus for putting a sewing thread through an eye hole of a sewing needle of a sewing machine, comprising:

a threading hook including a hook portion which is movable through the eye hole of the sewing needle to catch the sewing thread positioned adjacent to the needle eye;

a holding member which is biased against the sewing thread caught by the hook portion of said threading hook;

a supporting member which supports said threading hook and said holding member such that the threading hook and the holding member are movable between a distant position thereof distant from the needle eye and a near position thereof near to the needle eye and are movable at said near position so that said hook portion of the threading hook advances and retracts through the needle eye to catch the sewing thread, draw the caught thread through the needle eye, and obtain a loop of the thread; and a thread releasing member which releases the sewing thread from said threading hook by moving said holding member away from said hook portion of the threading hook when the threading hook and the holding member are moved from said near position to said distant position after the hook portion of the threading hook obtains said loop of the thread, at least one of said supporting member and said releasing member being movable relative to the other of the supporting member and the releasing member so that the holding member supported by the supporting member, and the releasing member are engaged with each other and the holding member is moved away from the hook portion of the threading hook.

2. An apparatus according to claim 1, wherein said holding member comprises a flexible member including a holding portion and a biasing portion which biases said holding portion to press the sewing thread against the threading hook and wherein said releasing member releases the sewing thread from the threading hook by moving said flexible member by an amount sufficient to release the sewing thread.

3. An apparatus according to claim 1, wherein said supporting member supports said threading hook such that the threading hook is movable along a movement route between a higher position as said distant position and a lower position as said near position and is movable at said lower position so that said hook portion thereof advances and retracts through the needle eye.

4. An apparatus according to claim 3, wherein said releasing member has a guide surface which is fixed in said movement route of said threading hook against which the sewing thread is pressed by said holding member, said guide surface being inclined with respect to the movement route so that when the threading hook is moved along the movement route, the holding member is guided by the guide surface and is moved away from the hook portion of the threading hook.

5. An apparatus according to claim 1, further comprising a moving device which moves said one of said supporting member and said releasing member relative to said other of the supporting member and the releasing member so that the holding member supported by the supporting member, and the releasing member are engaged with each other and the holding member is moved away from said hook portion of the threading hook against the biasing action of said biasing portion.

6. An apparatus according to claim 5, wherein said moving device moves said supporting member supporting said threading hook against which the sewing thread is pressed by said holding member, so that the holding member is engaged with an inclined guide surface of said releasing member which is inclined with respect to a route of the movement of the threading hook by said moving device, and the holding member is moved away from said hook portion of the threading hook.

7. An apparatus according to claim 5, wherein said moving device comprises a laterally oscillating device of the sewing machine which laterally oscillates a needle bar to which the sewing needle is secured, so as to form zigzag stitches, said laterally oscillating device moving said supporting member relative to said releasing member.

8. An apparatus according to claim 7, wherein said releasing member is fixed to a frame member of the sewing machine.

9. An apparatus according to claim 1, further comprising a base member which supports said supporting member and said releasing member.

10. An apparatus according to claim 9, wherein said supporting member comprises a support bar which supports said threading hook and holding member, and said support bar being supported by said base member such that the support bar is rotatable about an axis line thereof and is movable along said axis line relative to the base member, said releasing member being fixed to the base member.

11. An apparatus according to claim 1, further comprising a holding-member disengaging member which disengages, when said threading hook and said holding member are positioned at said near position and said hook portion of said threading hook advances and retracts through the needle eye, said holding member from the hook portion of said threading hook and thereby inhibits the holding member from contacting the sewing needle and allows the hook portion of the threading hook to catch the sewing thread, draw the caught thread through the needle eye and obtain said loop of the thread.

12. An apparatus according to claim 1, further comprising an adjusting device which adjusts a position of said releasing member relative to the needle eye, and thereby adjusts a length of the loop of the sewing thread to a desired value.

13. An apparatus according to claim 1, wherein said releasing member is formed of a deformable material so that a position of the releasing member relative to the needle eye is adjustable by deformation thereof.

14. An apparatus according to claim 13, wherein said releasing member comprises a metallic wire.

* * * * *